US011364536B1

(12) United States Patent
Johnson et al.

(10) Patent No.: US 11,364,536 B1
(45) Date of Patent: Jun. 21, 2022

(54) LAYERED SLAB MANUFACTURING SYSTEM AND METHOD

(71) Applicant: DEERE & COMPANY, Moline, IL (US)

(72) Inventors: Eric M. Johnson, Geneseo, IL (US); Matthew Frank, Ames, IA (US); Hema V. Guthy, Moline, IL (US); Kalathur Pattabiraman, Bettendorf, IA (US); Ali Tayh, Bettendorf, IA (US); Darren J. Hellman, Gilbertville, IA (US); Michael C. Paisley, Solon, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/323,420

(22) Filed: May 18, 2021

(51) Int. Cl.

| | |
|---|---|
| ***B22C 7/00*** | (2006.01) |
| ***B22C 9/20*** | (2006.01) |
| ***B22C 9/18*** | (2006.01) |

(52) U.S. Cl.
CPC ..... *B22C 7/00* (2013.01); *B22C 9/18* (2013.01); *B22C 9/20* (2013.01)

(58) Field of Classification Search
CPC .... B22C 7/00; B22C 9/18; B22C 9/20; B22C 7/04
See application file for complete search history.

(56) References Cited

U.S. PATENT DOCUMENTS 2,399,373 A * 4/1946 Miller ..... B22C 7/04 164/13

OTHER PUBLICATIONS

Luo, Xiaoming, "Process planning for an Additive/Subtractive Rapid Pattern Manufacturing system" (2009). Graduate Theses and Dissertations. Paper 11027. (Year: 2009).*
Robotic Solutions, Inc.; "Handling Foundry Sand Molds"; Shows 2-piece sand molds with recessed flat surfaces on the sides, and a robot with grips that fit these recesses to manipulate the molds; Video: https://www.youtube.com/watch?v=XPtTi8_Dvsl.
Exone Excast Program / 3D Printing for Sand Casting; Additively manufactures solid/bound sand slabs (possibly of varying thicknesses), then combines them to form sand molds; Video: https://www.youtube.com/watch?v=ENKSgeVOHwM.
Department of Industrial and Manufacturing Systems Engineering, Iowa State University, Matthew C. Frank, Frank E. Peters, Xioming Luo, Fanqi Meng, Joseph Petrzelka; "A Hybrid Rapid Pattern Manufacturing System for Sand Castings"; Academic Paper: http://utw10945.utweb.utexas.edu/Manuscripts/2009/2009-05-Frank.pdf; pp. 11; Date: May 2009.

(Continued)

*Primary Examiner* — Kevin P Kerns
*Assistant Examiner* — Steven S Ha
(74) *Attorney, Agent, or Firm* — Taft Stettinius & Hollister LLP; Stephen F. Rost

(57) ABSTRACT

A manufacturing method uses layered slabs to create a final pattern for a mold or for creating the mold itself. The method includes: preparing a desired number of slabs including a first slab and a second slab; machining the first slab; machining the second slab; and after the second slab is coupled to the first slab, repeating the machining step for each additional slab included in the desired number of slabs to form the final pattern or mold.

16 Claims, 11 Drawing Sheets

(56) References Cited

OTHER PUBLICATIONS

Robotic Solutions, Inc.; "Handling Foundry Sand Molds"; Shows 2-piece sand molds with recessed flat surfaces on the sides, and a robot with grips that fit these recesses to manipulate the molds; Video: https://www.youtube.com/watch?v=XPtTi8_Dvsl; Date: Feb. 7, 2008.

Exone Excast Program / 3D Printing for Sand Casting; Additively manufactures solid/bound sand slabs (possibly of varying thicknesses), then combines them to form sand molds; Video: https://www.youtube.com/watch?v=ENKSgeVOHwM; Date: Dec. 2, 2014.

* cited by examiner

LAYERED SLAB MANUFACTURING SYSTEM AND METHOD

FIELD OF THE DISCLOSURE

The present disclosure relates to manufacturing processes for end-components, and more particularly to systems and methods for creating patterns and molds that can be used to create end-components.

BACKGROUND

Sand casting, also known as sand molded casting, is a metal casting process characterized by using sand as the mold material. Molds made of sand are relatively cheap, and sufficiently durable for most industrial uses. In addition to the sand, a suitable bonding agent may be mixed with the sand. The mold cavities are often created by compacting the sand molds around models of the end-component that the manufacturer desires to produce. The models of the end-components are called patterns. The patterns may also be created by carving directly into the sand, or by 3D printing. The patterns and molds can be formed of other materials as well, which introduce the opportunity for improvements within the process traditionally known as sand casting.

Therefore, there is a need for improved automation within finite portions of sand casting processes. For example, the patterns and the molds themselves can be created more expeditiously and cost effectively, using new techniques and unique process steps, which are recited herein.

SUMMARY

In an illustrative embodiment, a method of manufacturing a final pattern for a mold using layered slabs comprises: preparing a desired number of slabs including a first slab and a second slab; machining the first slab with an automated machining tool; adhering the second slab to the first slab; machining the second slab with the automated machining tool; and repeating the adhering step and subsequent machining step for each additional slab included in the desired number of slabs to form the final pattern.

In some embodiments, each slab is comprised of a first material. In some embodiments, the first material is comprised of: at least one of: polyamide, acrylonitrile styrene acrylate, polycarbonate, thermoplastic polyurethane, polypropylene, another thermal plastic, steel weld wire, and aluminum weld wire.

In some embodiments, the method further comprises: applying a second material to the final pattern; shaping the second material to match contours of the final pattern; removing the second material from the final pattern to form a mold; and forming an end-component by applying a third material to the mold. In some embodiments, the second material is comprised of at least one of: sand, steel, and aluminum.

In some embodiments, the automated machining tool includes a machining portion having a length; each slab included in the desired number of slabs has a height; and the length of the machining portion of the automated machining tool is greater than the height of each respective slab.

In some embodiments, the method further comprises identifying an initial pattern prior to the step of preparing the desired number of slabs. In some embodiments, the initial pattern is a three dimensional model of the final pattern. In some embodiments, the initial pattern comprises a plurality of layers. In some embodiments, the desired number of slabs is equal to the number of layers included in the plurality of layers of the initial pattern.

In some embodiments, the method further comprises identifying an initial pattern prior to the step of preparing the desired number of slabs. In some embodiments, the initial pattern is a three dimensional model of the final pattern. In some embodiments, the initial pattern comprises a plurality of layers. In some embodiments, preparing the desired number of slabs includes forming each slab to include a near net shape corresponding to a layer of the initial pattern.

In some embodiments, preparing the desired number of slabs includes forming each slab to have an identical border surrounding the near net shape of the slab. In some embodiments, preparing the desired number of slabs includes forming each slab to include a grid of at least one repeating geometric shape coupled to the border and the near net shape of the slab.

In some embodiments, each machining step includes: removing the grid and border from the near net shape of the slab; and removing an excess portion of the near net shape of the slab to form a finished portion of the final pattern based on a corresponding layer of the identified initial pattern. In some embodiments, the adhering step includes adhering a near net shape of the second slab to the finished portion of the first slab.

In some embodiments, the method further comprises positioning the border of the first slab in a predetermined location that is associated with an automated machining tool prior to machining the first slab. In some embodiments, the method further comprises aligning the second slab with the predetermined location prior to adhering the second slab to the first slab.

An another illustrative embodiment, a method of manufacturing a final pattern for a mold using layered slabs comprises: preparing a first slab; machining the first slab; preparing a second slab atop the first slab such that the second slab is coupled to the first slab; machining the second slab; and repeating the preparing atop step and the subsequent machining step for each additional slab included in the final pattern.

In some embodiments, the method further comprises identifying an initial pattern prior to the step of preparing the first slab. In some embodiments, the initial pattern is a three dimensional model of the final pattern. In some embodiments, the initial pattern comprises a plurality of layers. In some embodiments, the preparing and preparing atop steps include forming each slab to include a near net shape corresponding to a layer of the initial pattern.

In some embodiments, the preparing and preparing atop steps include: forming each slab to have an identical border surrounding the near net shape of the slab; and forming each slab to including a grid of at least one repeating geometric shape coupled to the border and the near net shape of the slab.

In some embodiments, the machining step includes: removing the grid and border from the near net shape of the slab; and removing an excess portion of the near net shape of the slab to form a finished portion of the final pattern based on a corresponding layer of the identified initial pattern.

In some embodiments, the method further comprises positioning the border of the first slab in a predetermined location that is associated with an automated machining tool prior to machining the first slab with the automated machining tool. In some embodiments, preparing a second slab atop the first slab includes aligning the second slab with the predetermined location.

In another illustrative embodiment, a method of manufacturing a final mold using layered slabs comprises: identifying an initial mold that is a three dimensional model of a final mold, wherein the initial mold comprises a plurality of layers; preparing a desired number of slabs including a first slab and a second slab, wherein each slab is comprised of a first material; machining the first slab based on a corresponding layer of the identified initial mold; adhering the second slab to the first slab; machining the second slab based on a corresponding layer of the identified initial mold; repeating the adhering step and subsequent machining step for each additional slab included in the desired number of slabs to form the final mold; and forming an end-component by applying a second material to the final mold. In some embodiments, the first material is comprised of at least one of: sand, steel, or aluminum.

In some embodiments, preparing the desired number of slabs includes forming each slab to have an identical border. In some embodiments, the method further comprises positioning the border of the first slab in a predetermined location that is associated with an automated machining tool prior to machining the first slab with the automated machining tool; and aligning the second slab with the predetermined location prior to adhering the second slab to the first slab.

In another illustrative embodiment, a system for manufacturing a final pattern for a mold using layered slabs includes: a machining tool; an extruding tool configured to extrude a first material; a slab placement tool; an adhesive application tool; and a controller operatively coupled to each of the tools, wherein the controller is configured to instruct at least one of the tools to perform the steps of the methods recited above.

In another illustrative embodiment, a system for manufacturing a final mold using layered slabs comprises: a machining tool; an extruding tool configured to extrude a first material; a slab placement tool; an adhesive application tool; and a controller operatively coupled to each of the tools. The controller is configured to instruct at least one of the tools to perform the steps of the methods recited above.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein:

FIG. 3 illustrates two layers of the initial pattern;

FIG. 5 illustrates a portion of a machining tool of the system;

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
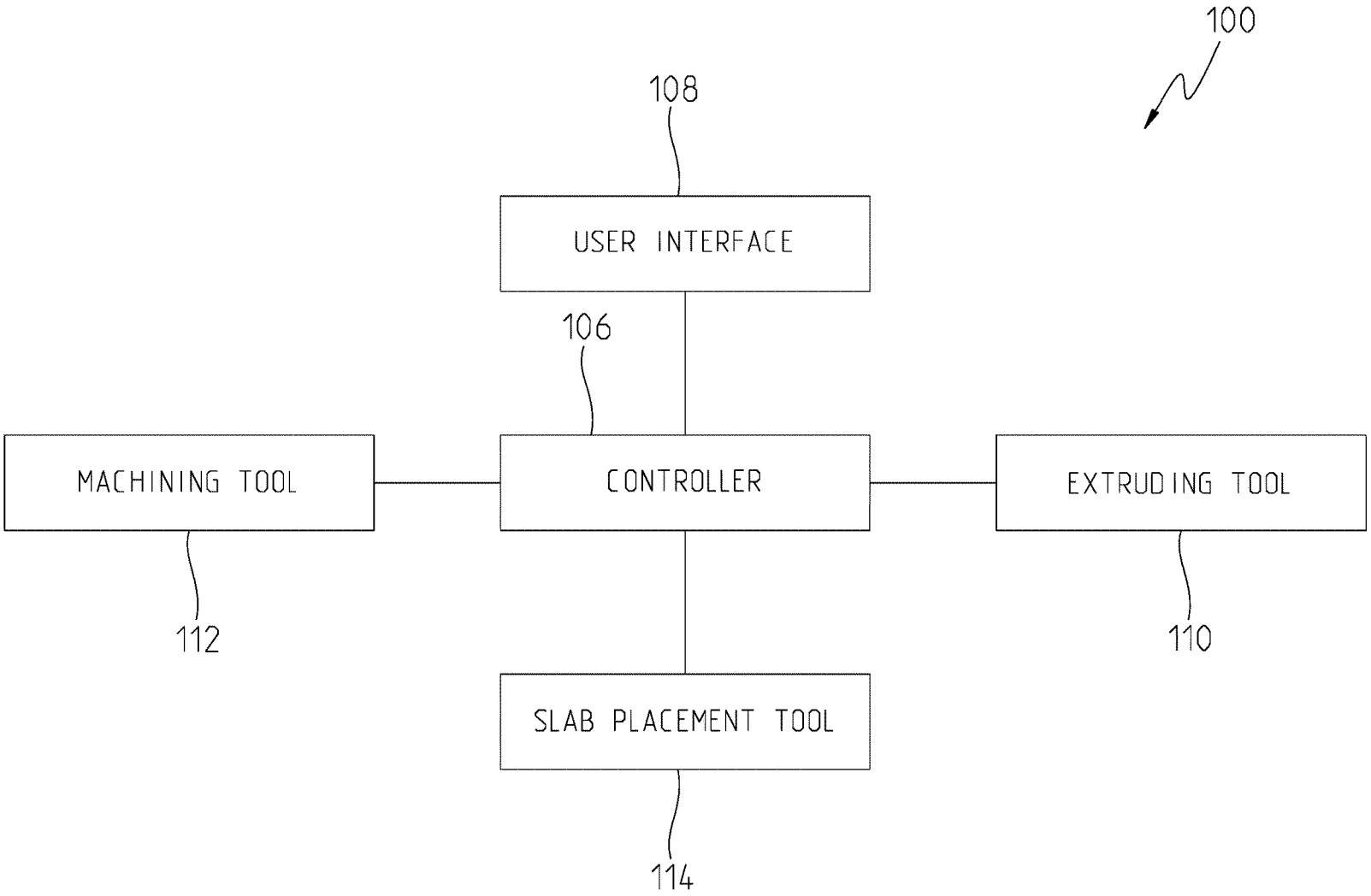
FIG. 1 illustrates a diagrammatic view of a system used to manufacture a final pattern for a mold.

FIG. 1 illustrates a diagrammatic view of a control system 100 used to manufacture a final pattern 102 for a mold. The control system 100 includes a controller 106 operatively coupled to a user interface 108. The user interface 108 is configured to send signals to the controller 106 based on inputs from a user. The user interface 108 may be a touch screen device or other input device by which the user may communicate inputs to the control system 100. The controller 106 may include a memory and a processor configured to execute instructions (i.e. algorithmic steps) stored on the memory. The controller 106 may be a single controller or a plurality of controllers operatively coupled to each other. The controller 106 may be hardwired or connected wirelessly to other components of the control system 100 via Wi-Fi, Bluetooth, or other known means of wireless communication. The controller 106 may be mechanically coupled to other components of the control system 100 or positioned remotely, away from the other components.

The control system 100 further includes an extruding tool 110, a machining tool 112, and a slab placement tool 114, which are each operatively coupled to the controller 106. The controller 106 is configured to send signals to the extruding tool 110, the machining tool 112, and the slab placement tool 114 based on signals received from the user interface 108 and/or based on instructions stored on the memory of the controller 106. The instructions (i.e. algorithmic steps) will be described in greater detail below. The machining tool 112 includes a machining portion having a length 150 (see FIG. 5), and therefore, if a valley or trough meant to be machined is deeper than the length 150 of the machining portion of machining tool 112, then the machining tool 112 cannot perform the machining step instructed by the controller 106. This limitation introduces the need for a layered slab method of manufacturing, in which no slab has a height greater than the length 150 of the machining tool 112. In other words, the feature of each slab having a height that is lesser than the length 150 of the machining portion of machining tool 112 is included in each method of manufacturing (200, 300, 400) described below. It should be appreciated that in embodiments in which the slabs are arranged adjacent to each other rather than stacked on top of each other, the thickness of each slab is lesser than the length 150 of the machining portion of machining tool 112. Therefore, thickness and height of the slabs are used interchangeably herein where applicable.

Figure 2:
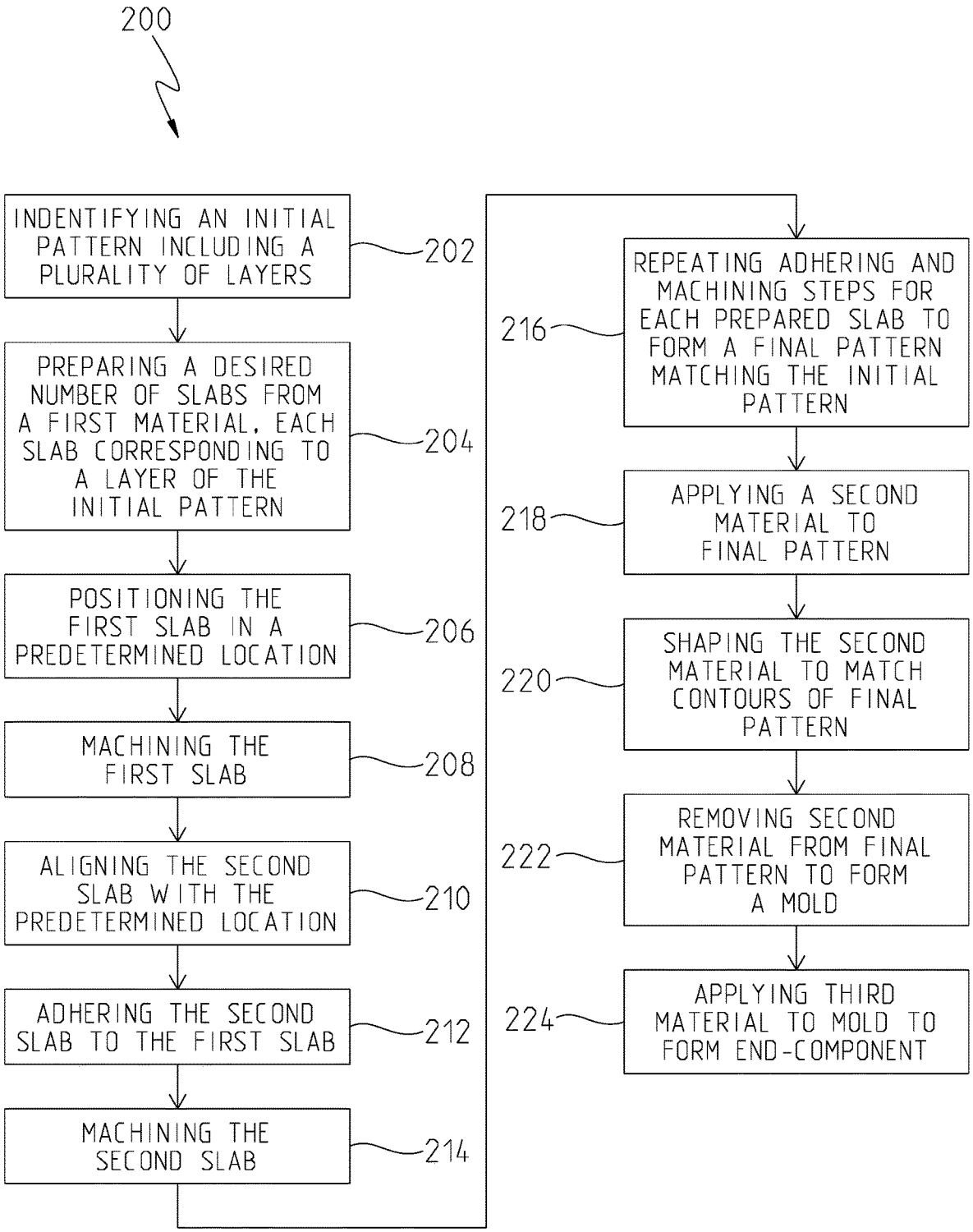
FIG. 2 illustrates a flow chart showing a method of manufacturing a final pattern for a mold.

FIG. 2 illustrates a flow chart showing steps included in a method of manufacturing a final pattern 102 (see FIG. 6) that can be used to create a mold. The method of manufacturing the final pattern 102 for the mold is illustrated by the reference number 200. As shown FIG. 2, the method 200 includes a step 202 of identifying an initial pattern 116 (see FIG. 3). The initial pattern 116 is a digital representation of the final pattern 102, and the final pattern 102 is a physical object formed of slabs of material as described in greater detail below.

Figure 3:
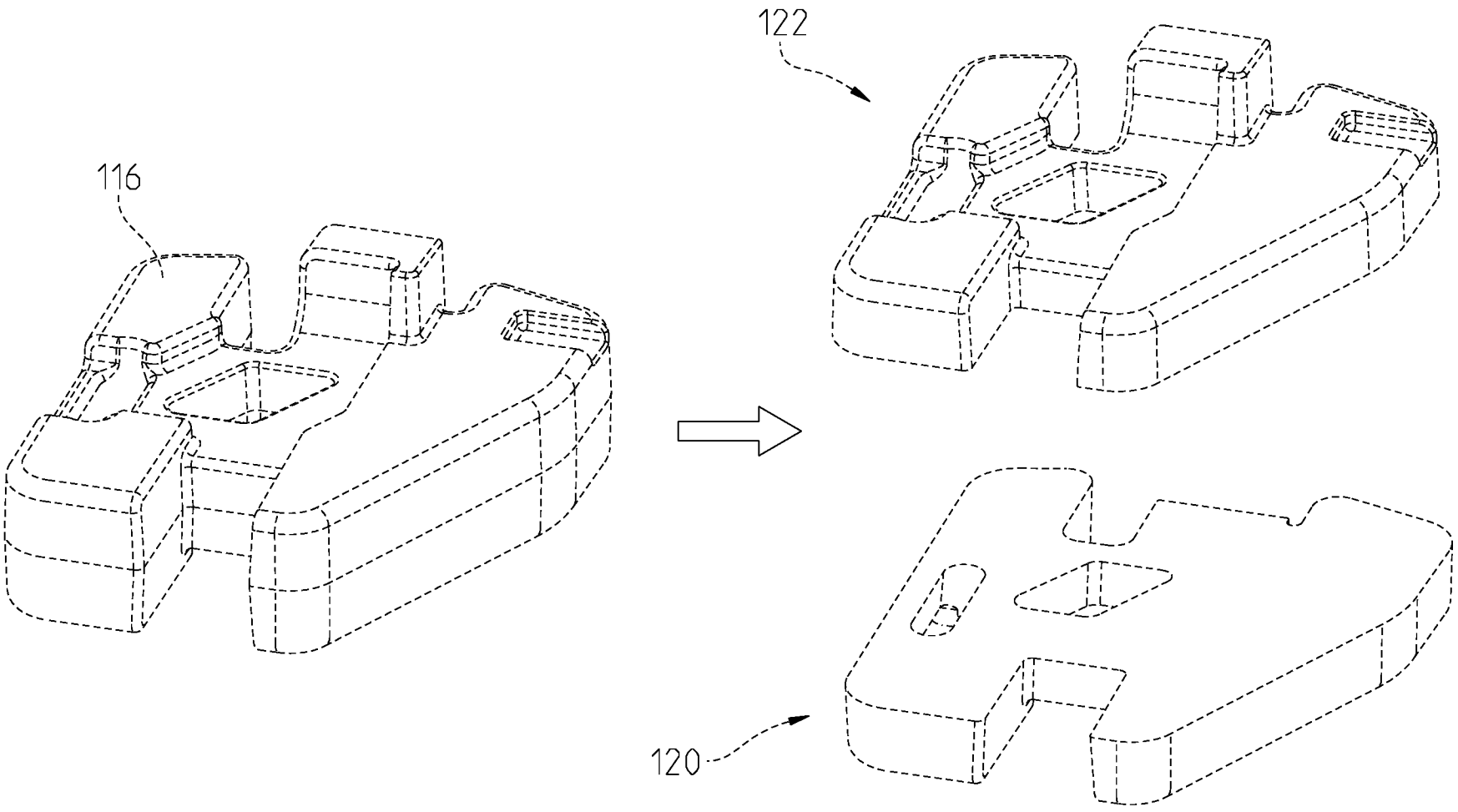
FIG. 3 illustrates a three dimensional model or digital representation of a final pattern, which is referred to herein as an initial pattern.

As shown in FIG. 3, the initial pattern 116 comprises a plurality of layers, e.g., 120, 122. In the illustrative embodiment, the layers 120, 122 are horizontally extending portions of the initial pattern 116. In other embodiments, the layers may be vertically extending portions of the initial pattern 116. In some embodiments, each layer has a uniform height (or thickness), and in other embodiments, the layers may differ in height (or thickness) from each other. The initial pattern 116 is a digital representation or three dimensional model of the final pattern 102, the final pattern 102 is used to create the mold, and subsequently the mold is used to create a plurality of end-components having the same size and shape as the final pattern 102 and as the three dimensional model.

Figure 4:
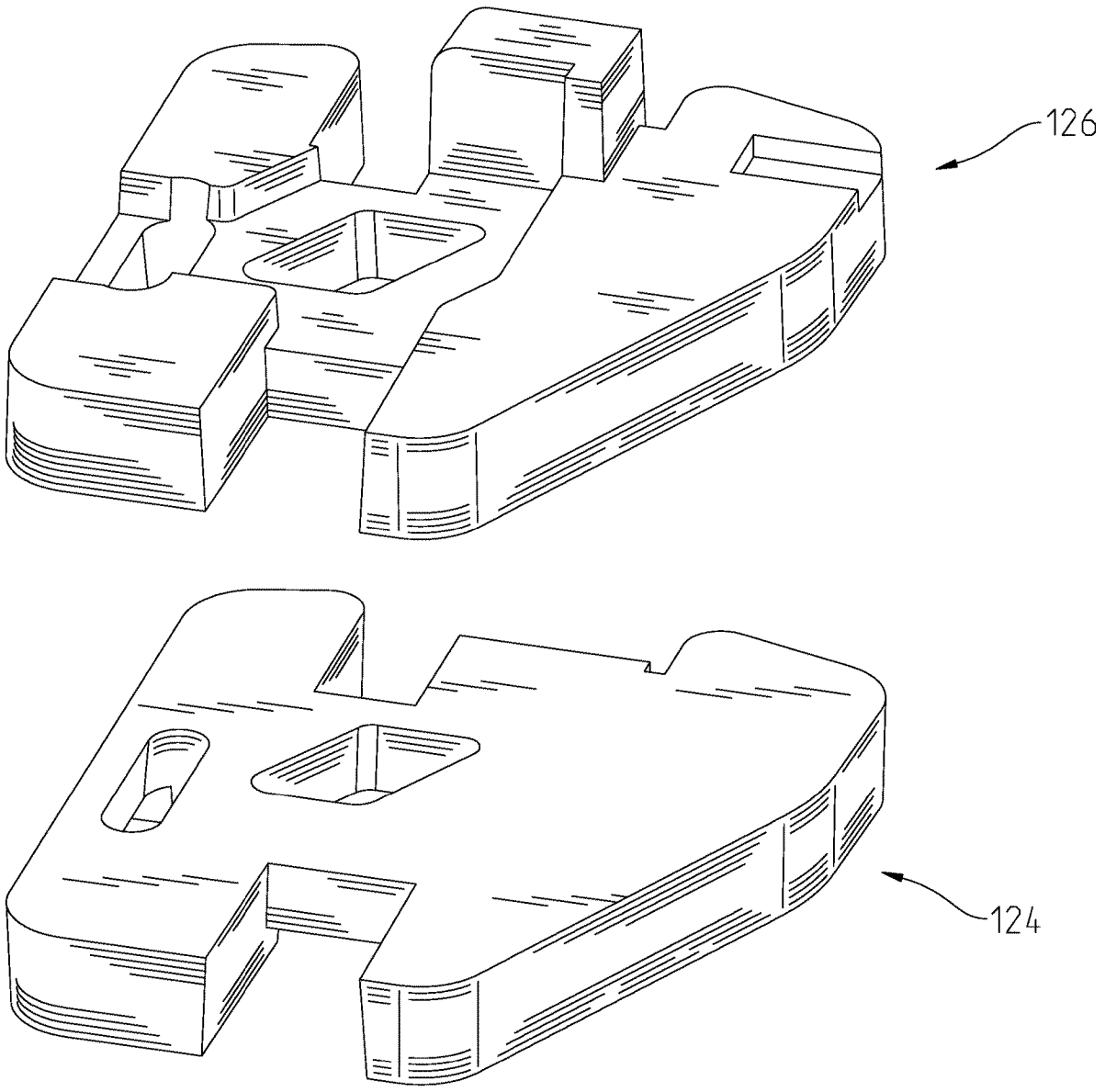
FIG. 4 illustrates two slabs formed by an extruding tool of the system.

Referring again to FIG. 2, the method 200 includes a step 204 of preparing a desired number of slabs including at least a first slab 124 and a second slab 126. Each slab corresponds to a different layer of the initial pattern 116. In the illustrative embodiment, e.g., FIG. 4, the slabs 124, 126 are each comprised of a first material. In some embodiments, a slab may include different portions that are spaced apart from one another. The different portions of a slab may be coupled to each other by a grid of repeating geometric shapes, which is described in more detail below.

An extruding tool 110, e.g., the extruding tool of FIG. 1, may be configured to extrude a first material to form the desired number of slabs. In some embodiments, the first material is comprised of at least one of: polyamide, acrylonitrile styrene acrylate, polycarbonate, thermoplastic polyurethane, polypropylene, another thermal plastic, steel weld wire, and aluminum weld wire.

Figure 7:
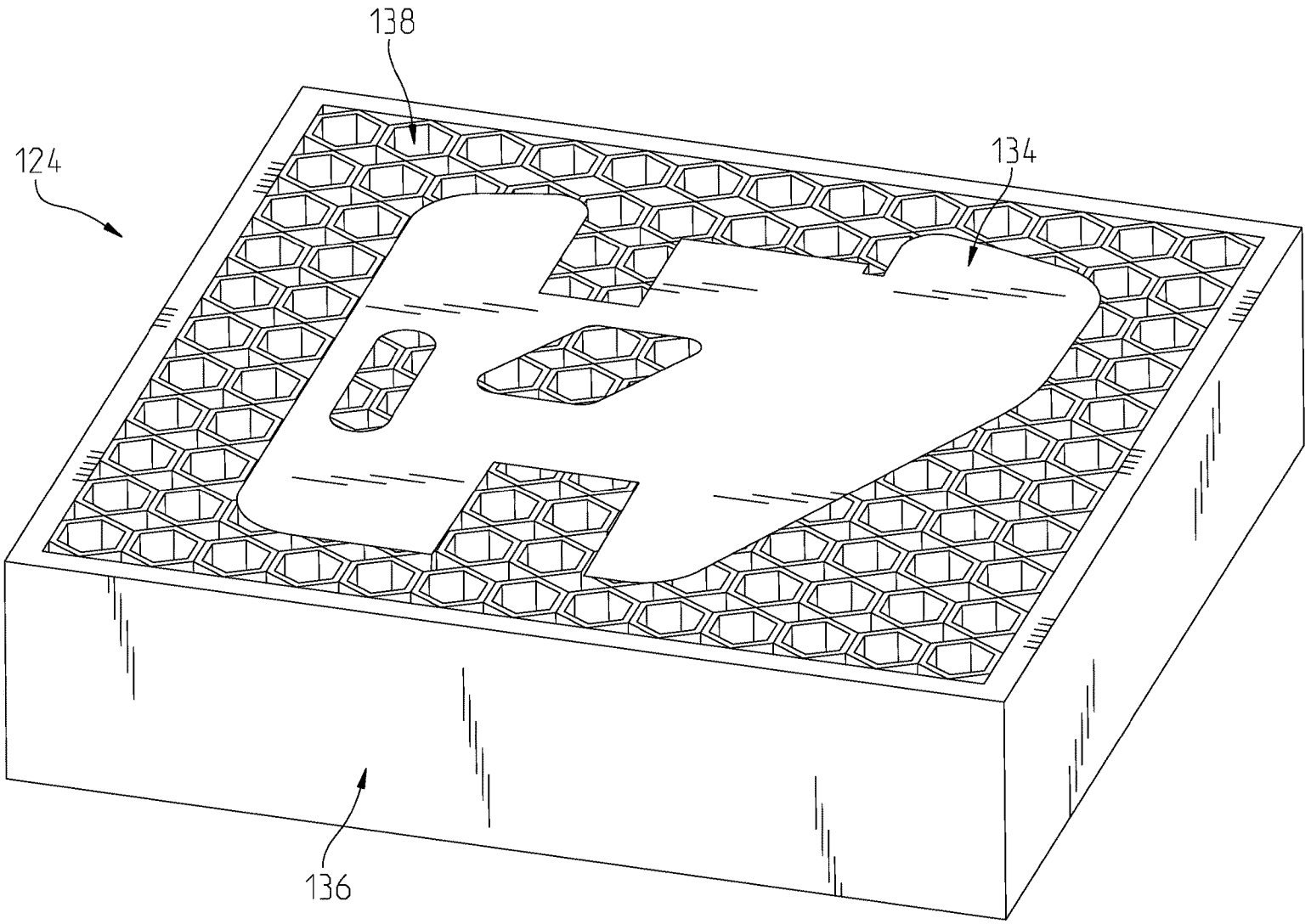
FIG. 7 illustrates a slab similar to one of the slabs of FIG. 4, but in addition to having a near net shape, the slab of FIG. 7 has a standard border and a grid connecting the near net shape and the standard border.

FIG. 7 is an illustrative embodiment of the slab 124 comprised of a first material. The slab 124 includes a near net shape 134. The slab 124 further includes a standard border 136 and a grid 138 of repeating geometric shapes. The grid 138 is coupled to the border 136 and to the near net shape 134. Although it is not discernable from FIG. 7, in some embodiments the slabs 124, 126 separate, i.e. spaced apart, sub-shapes indirectly coupled to each other by grid 138. While only slab 124 is shown in FIG. 7, it should be appreciated that the standard borders of the first and second slabs 124, 126 are identical to one another.

Figure 8:
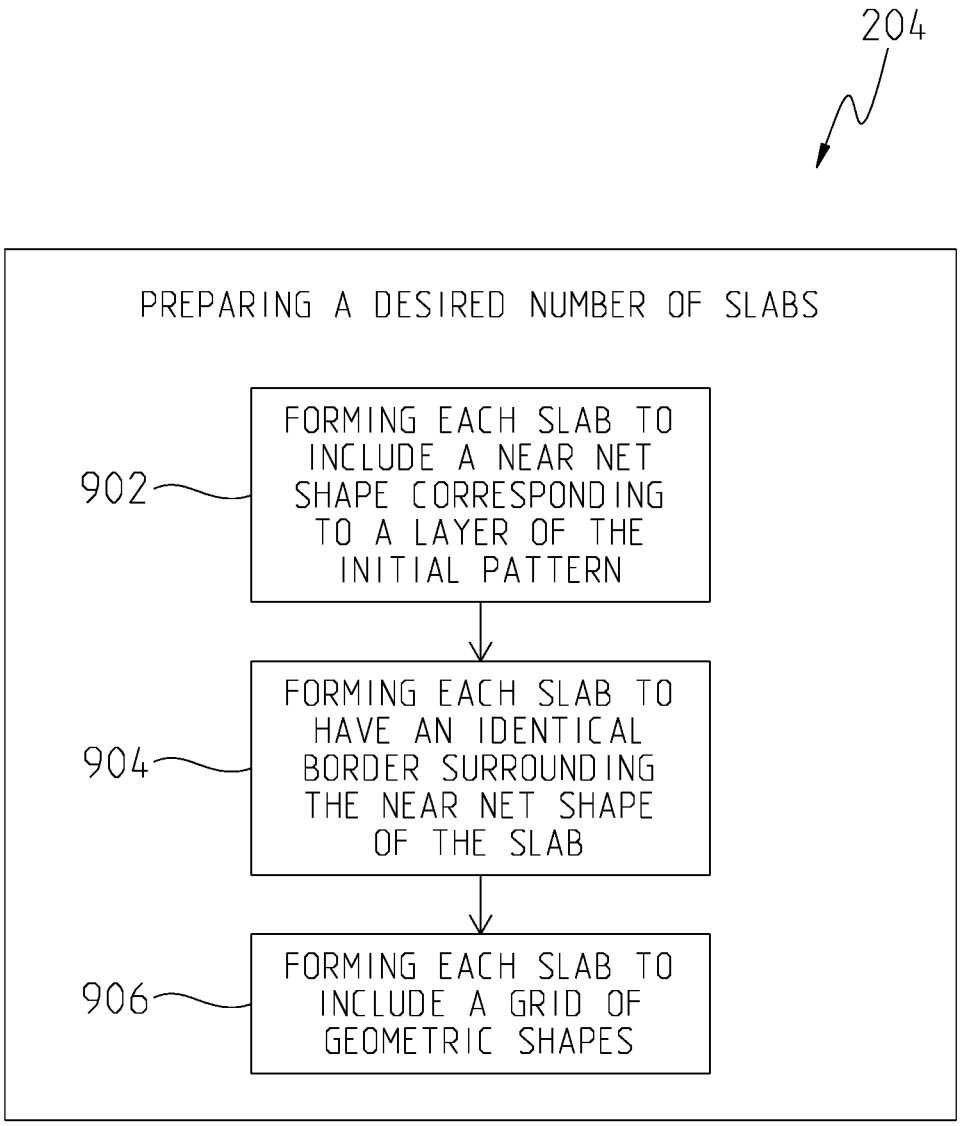
FIG. 8 illustrates a flow chart showing sub-steps included in the method shown in FIG. 2.

As shown in FIG. 8, the preparing step 204 includes a plurality of sub-steps 902, 904, and 906. The sub-step 902 includes forming each slab to include a near net shape that corresponds to a layer of the initial pattern 116. Each layer of the initial pattern 116 is a digital approximation of the near net shape of a corresponding slab. The sub-step 904 includes forming each slab to have an identical, standard border surrounding the near net shape of the slab. Constructing each slab with an identical, standard border allows the slabs to be automatically placed in a predetermined location relative to an automated machining tool as will be described in more detail below. The sub-step 906 includes forming each slab to include the grid 138.

Referring again to FIG. 2, after the desired number of slabs have been prepared, the method 200 includes a step 206 of positioning a standard border 134 of the first slab 124 in a predetermined location that is associated with the automated machining tool 112. The predetermined location may be stored in the memory of the controller 106. In some embodiments, in response to instruction from the controller 106, the slab placement tool 114 (see FIG. 1) automatically moves the first slab 124 to the predetermined location. In some embodiments, the slab placement tool 114 may be an electro-mechanical arm having a plurality of segments movable relative to each other such that the slab placement tool 114 is configured to obtain slabs and move the slabs to the predetermined location.

Figure 6:
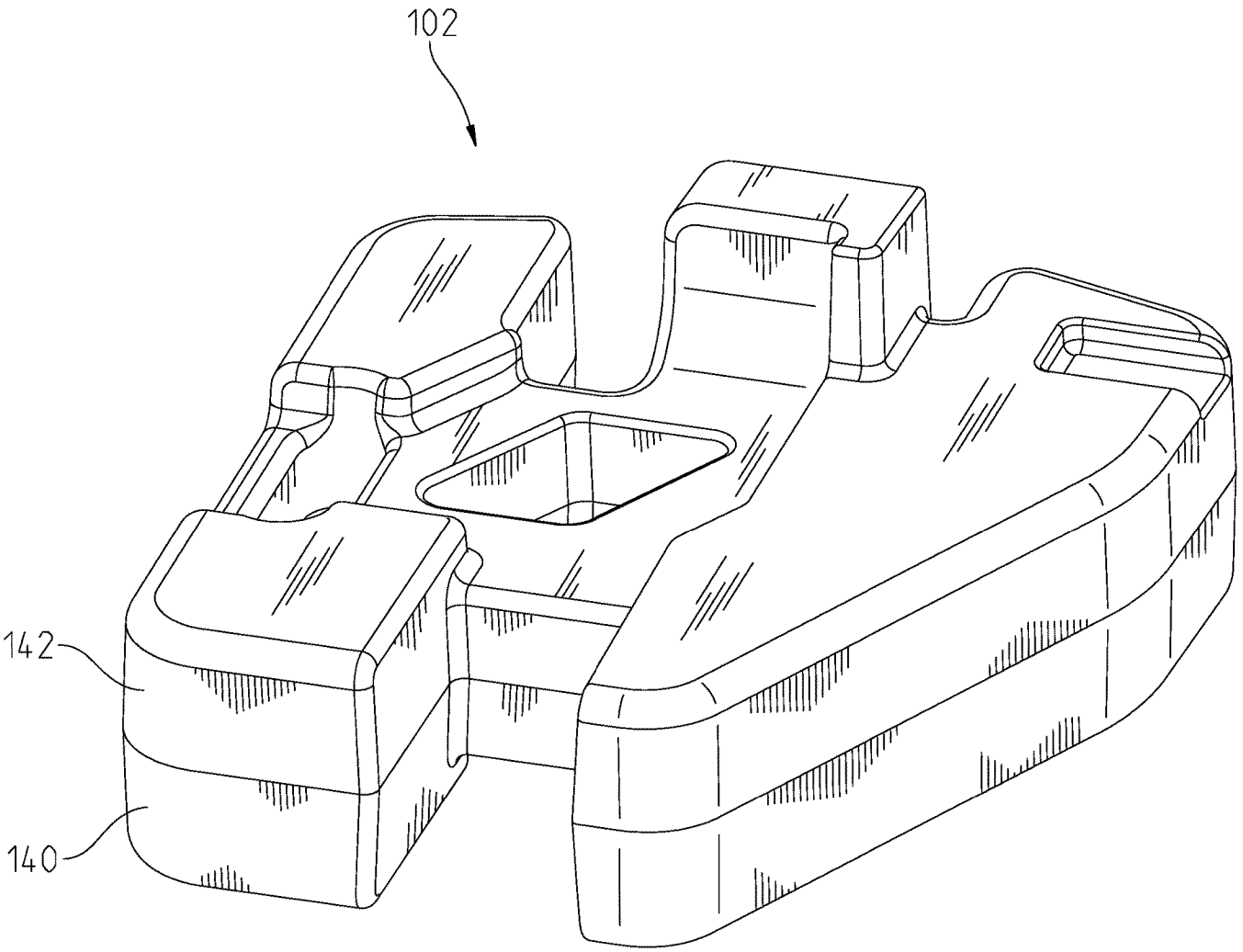
FIG. 6 illustrates a final pattern having two machined portions that correspond to the two layers of the initial pattern shown in FIG. 3.

The method 200 further includes a step 208 of machining the first slab 124 to form a finished portion 140 of the final pattern 102 (see FIG. 6). Since the initial pattern 116 has already been identified (and therefore, the size and shape of the final pattern 102 is stored in memory of the controller 106), the machining tool 112 automatically removes the undesired portions of the first slab 124 in response to instruction from the controller 106 to form a finished portion 140 of the final pattern 102. The machining tool 112 is able to do so since the first slab 124 is in a known location relative to the machining tool 112 (i.e. the predetermined location).

Figure 5:
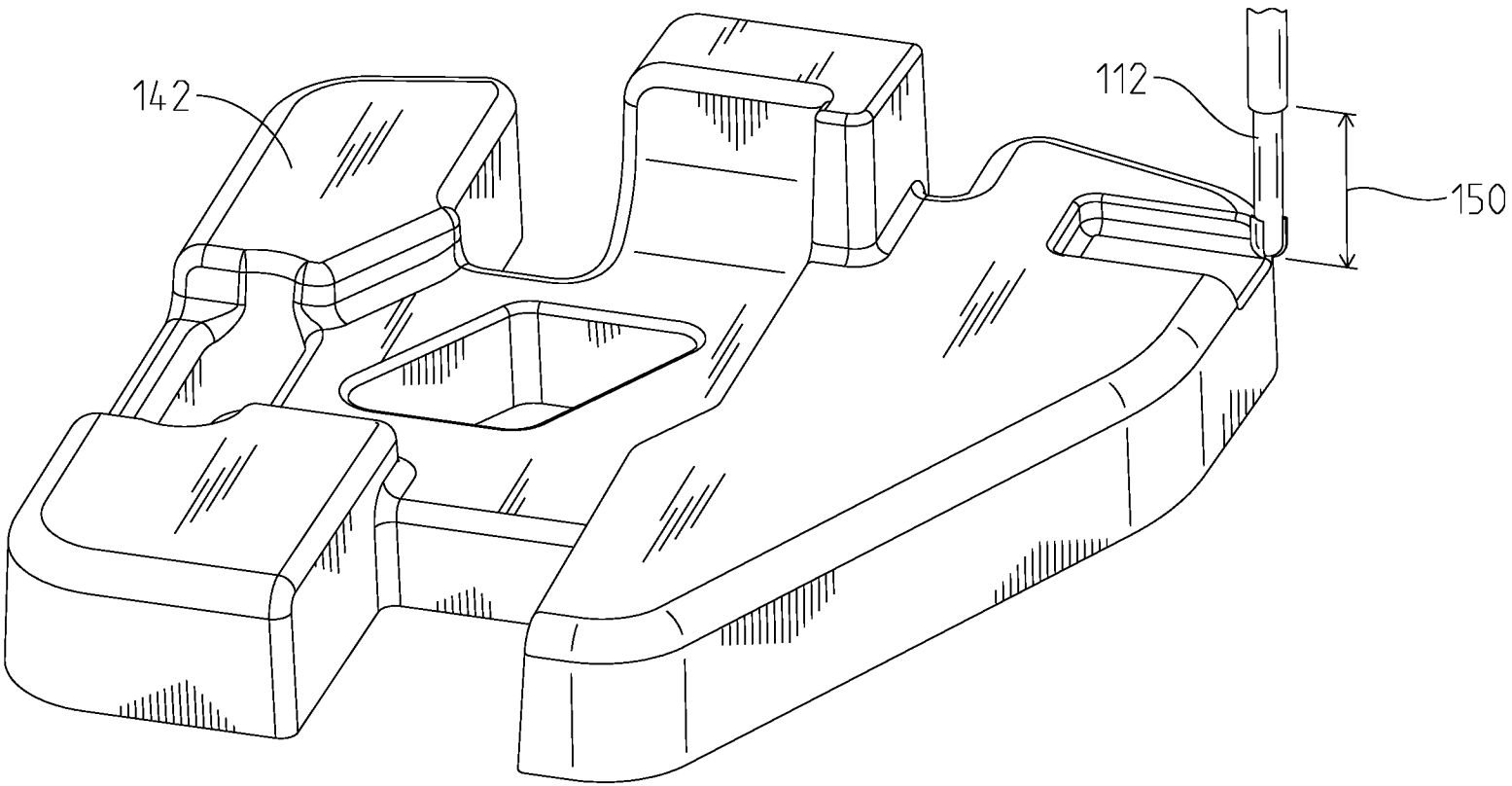
FIG. 5 illustrates a slab that has been machined to form a portion of the final pattern.
Figure 9:
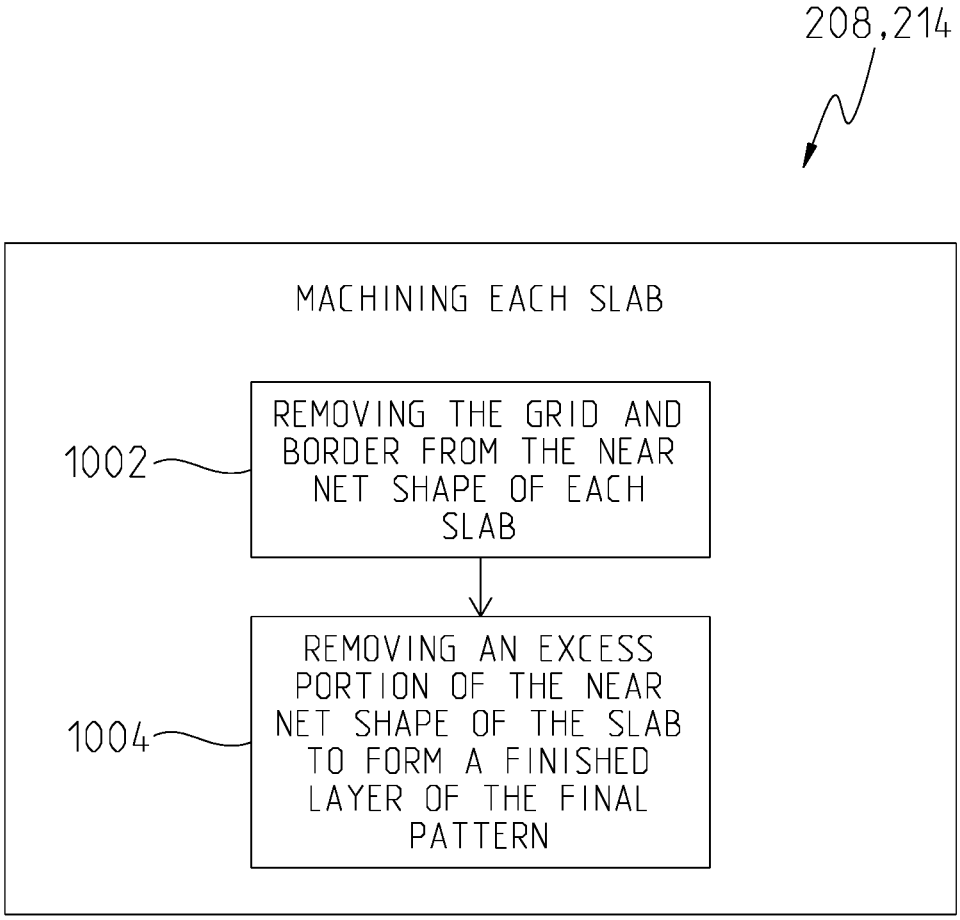
FIG. 9 illustrates another flow chart showing other sub-steps included in the method shown in FIG. 2.

As suggested by FIG. 9, the machining step 208 includes removing: (i) the standard border 136 and the grid 138 from the near net shape 134 of the first slab 124; and (ii) removing an excess portion of the near net shape 134 of the first slab 124 to form the finished portion 140 of the final pattern 102. The near net shape 134 is referred to as such because it is only an approximation (i.e. a near net shape) of the corresponding layer of the initial pattern 116. Because the initial pattern 116 is a digital representation of but otherwise identical to the final pattern 102, the near net shape 134 is also only an approximation of the finished portion 140 of the final pattern 102. A finished portion 142 of the final pattern 102 and the machining tool 112 are shown in FIG. 5. The sub-step of removing an excess portion of the near net shape 134 includes removing an excess portion of the near net shape 134 such that the remaining portion of the near net shape 134 matches the size and shape of the corresponding layer of the initial pattern 116. The remaining portion of the near net shape 134 is referred to as the finished portion 142 of the final pattern 102.

Referring again to FIG. 2, after the machining step 208, the method 200 includes a step 210 of aligning the border 136 of the second slab 126 with the predetermined location. The aligning step 210 includes positioning the second slab 126 above (or adjacent) the first slab 124 such that the border 136 of the second slab 126 is aligned with the location at which the border 136 of the first slab 124 was positioned prior to the machining step 208.

The method 200 then proceeds to a step 212 of adhering the second slab 126 to the first slab 124. The adhering step 212 includes adhering the near net shape 134 of the second slab 126 to the finished portion 140 resulting from the first slab 124. In some embodiments, the control system 100 includes an automated adhesive application tool that is operatively coupled to the controller 106. In some embodiments, the adhesive application tool automatically applies adhesive to the finished portion 140 or to the near net shape 134 of the second slab 126 in response to instruction from the controller 106. The second slab 126 may be coupled to the finished portion 140 after the adhesive is applied to one of the components 140, 126. In some embodiments, the coupling of the components 140, 126 may be performed by the slab placement tool 114 in response to instruction by the controller 106.

After the components 140, 126 have been adhered to one another, the method 200 then proceeds to a step 214 of machining the second slab 126. Similar to the machining step 208, the machining step 214 includes removing: (i) the standard border 136 and the grid 138 from the near net shape 134 of the second slab 126; and (ii) removing an excess portion of the near net shape 134 of the second slab 126 to form another finished portion 142 of the final pattern 102. The sub-step of removing an excess portion includes removing an excess portion of the near net shape 134 such that the remaining portion of the near net shape 134 matches the size and shape of the corresponding layer of the initial pattern 116. The remaining portion of the near net shape 134 is referred to as the finished portion 142 of the final pattern 102.

The method 200 further includes a step 216. The step 216 is comprised of repeating the aligning step 210, the adhering step 212, and the subsequent machining step 214 for each additional slab included in the desired number of slabs to form the final pattern 102. After the final pattern 102 is formed, the mold and subsequently the end-components may be formed according to the steps described below.

The method 200 includes a step 218 of applying a second material to the final pattern 102. In some embodiments, the second material is comprised of at least one of: sand, steel, and aluminum. The method 200 then proceeds to a step 220 of shaping the second material against the final pattern 102 such that the second material mirrors the contours of the final pattern 102. The method 200 then proceeds to a step 222 of removing the second material from the final pattern 102 to form a mold. The method 200 then proceeds to a step 224 of applying a third material to the mold to form an end-component. Step 224 may be repeated a number of times based on the desired number of end-components to be created from the mold.

Figure 10:
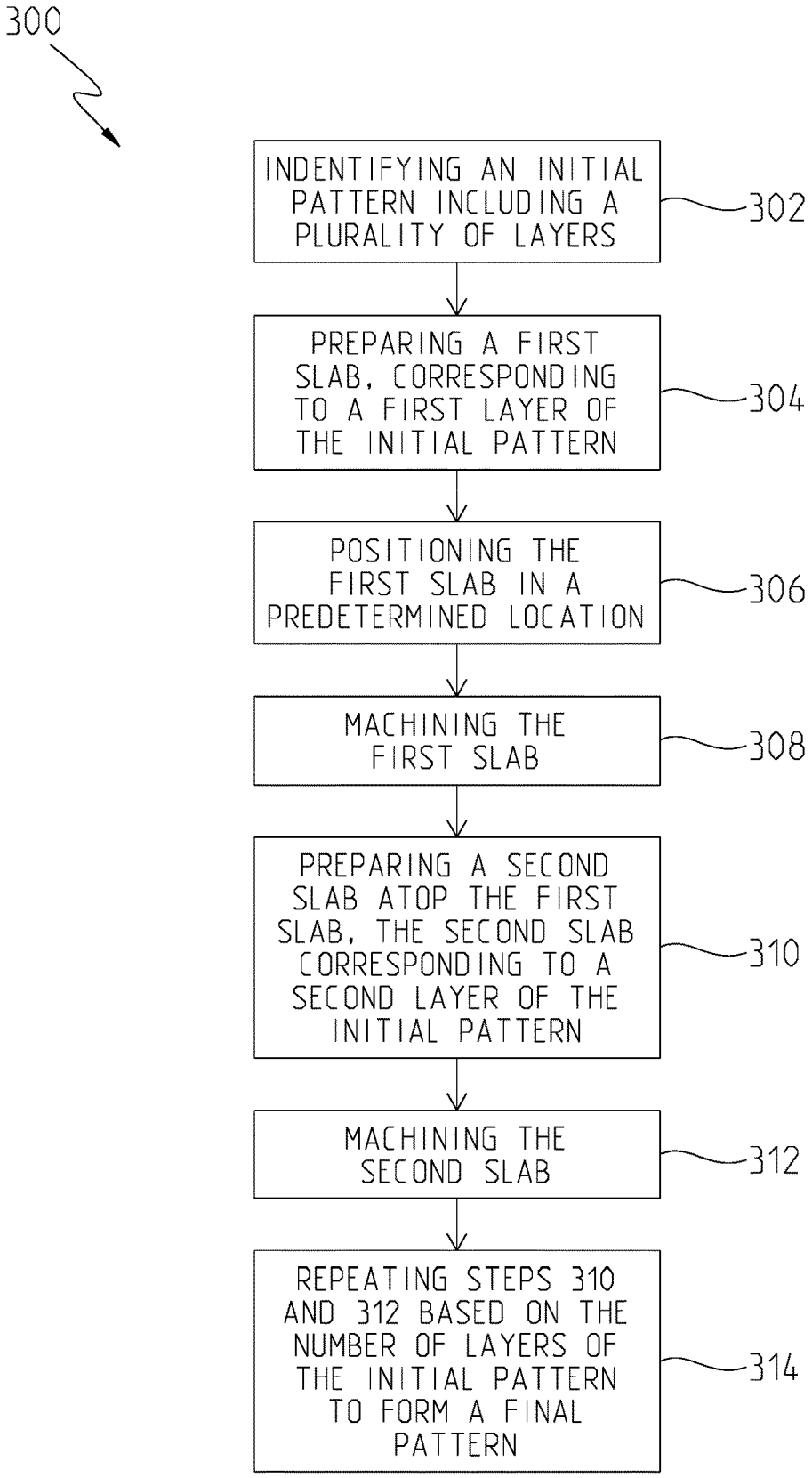
FIG. 10 illustrates a flow chart showing another method of manufacturing a final pattern for a mold.

FIG. 10 illustrates another method 300 of manufacturing a final pattern 102 that can be used to create a mold. While some steps of the method 300 are similar to steps of the method 200, a difference is that, in the method 300, each subsequent slab is prepared atop the prior slab without a separate adhering step.

Referring still to FIG. 10, the method 300 includes the step 302 of identifying an initial pattern 116, which as described above, is a three dimensional model or digital representation of the final pattern 102. The initial pattern 116 comprises a plurality of layers as described above. The method 300 further includes the step 304 of preparing a first slab 124 corresponding to a first layer of the initial pattern 116. The preparing step 304 includes the sub-steps of: forming the first slab 124 to include a near net shape corresponding to a layer of the initial pattern 116; forming the first slab 124 to have a standard border 136 surrounding the near net shape 134 of the first slab 124; and forming the first slab 124 to include a grid 138 of at least one repeating geometric shape coupled to the border 136 and the near net shape 134 of the first slab 124.

The method 300 then proceeds to a step 306 of positioning the border 136 of the first slab 124 in a predetermined location that is associated with the automated machining tool 112. After the positioning step 306, the method 300 proceeds to a step 308 of machining the first slab 124. The machining step 308 includes removing: (i) the standard border 136 and the grid 138 from the near net shape 134 of the first slab 124; and (ii) removing an excess portion of the near net shape 134 of the first slab 124 to form a finished portion 140 of the final pattern 102. The sub-step of removing an excess portion includes removing an excess portion of the near net shape 134 such that the remaining portion of the near net shape 134 matches the size and shape of the corresponding layer of the initial pattern 116. The remaining portion of the near net shape 134 is referred to as the finished portion 140 of the final pattern 102.

After the first slab 124 has been machined, the method 300 then proceeds to a step 310 of preparing a second slab 126 atop the first slab 124 such that the second slab 126 is coupled to the first slab 124 upon being prepared. In other words, in response to instruction by the controller 106, the extruding tool 110 extrudes a first material (i.e. the second slab 126) directly onto the finished portion 140 of the final pattern 102.

In some embodiments, the preparing atop step 310 includes one or more sub-steps such as: forming the second slab 126 to include a near net shape 134 corresponding to a second layer of the initial pattern 116; forming the second slab 126 to have a standard border 136 surrounding the near net shape 134 of the second slab 126; forming the second slab 126 to including a grid 138 of at least one repeating geometric shape that is coupled to the border 136 and the near net shape 134 of the second slab 126. It should be appreciated that the standard borders of the first and second slabs 124, 126 are identical. In some embodiments, the preparing atop step 310 includes aligning the standard border 134 of the second slab 126 with the predetermined location. In other words, the standard border 134 of the second slab 126 is positioned directly above the location where the standard border 134 of the first slab 124 was positioned prior to the machining step 308.

After the preparing atop step 310, the method 300 proceeds to a step 312 of machining the second slab 124. The machining step 312 includes removing: (i) the standard border 136 and the grid 138 from the near net shape 134 of the second slab 126; and (ii) removing an excess portion of the near net shape 134 of the second slab 126 to form another finished portion 142 of the final pattern 102. The sub-step of removing an excess portion includes removing an excess portion of the near net shape 134 such that the remaining portion of the near net shape 134 matches the size and shape of the corresponding layer of the initial pattern 116. The remaining portion of the near net shape 134 is referred to as the finished portion 142 of the final pattern 102.

The method then proceeds to a step 314 of repeating the preparing atop step 310 and the subsequent machining step 312 to form the final pattern 102. Step 314 is repeated the number of times that is required such that slabs are constructed for each corresponding layer of the initial pattern 116. In other words, the desired number of slabs to be prepared is equal to the number of layers included in the plurality of layers of the initial pattern 116.

Figure 11:
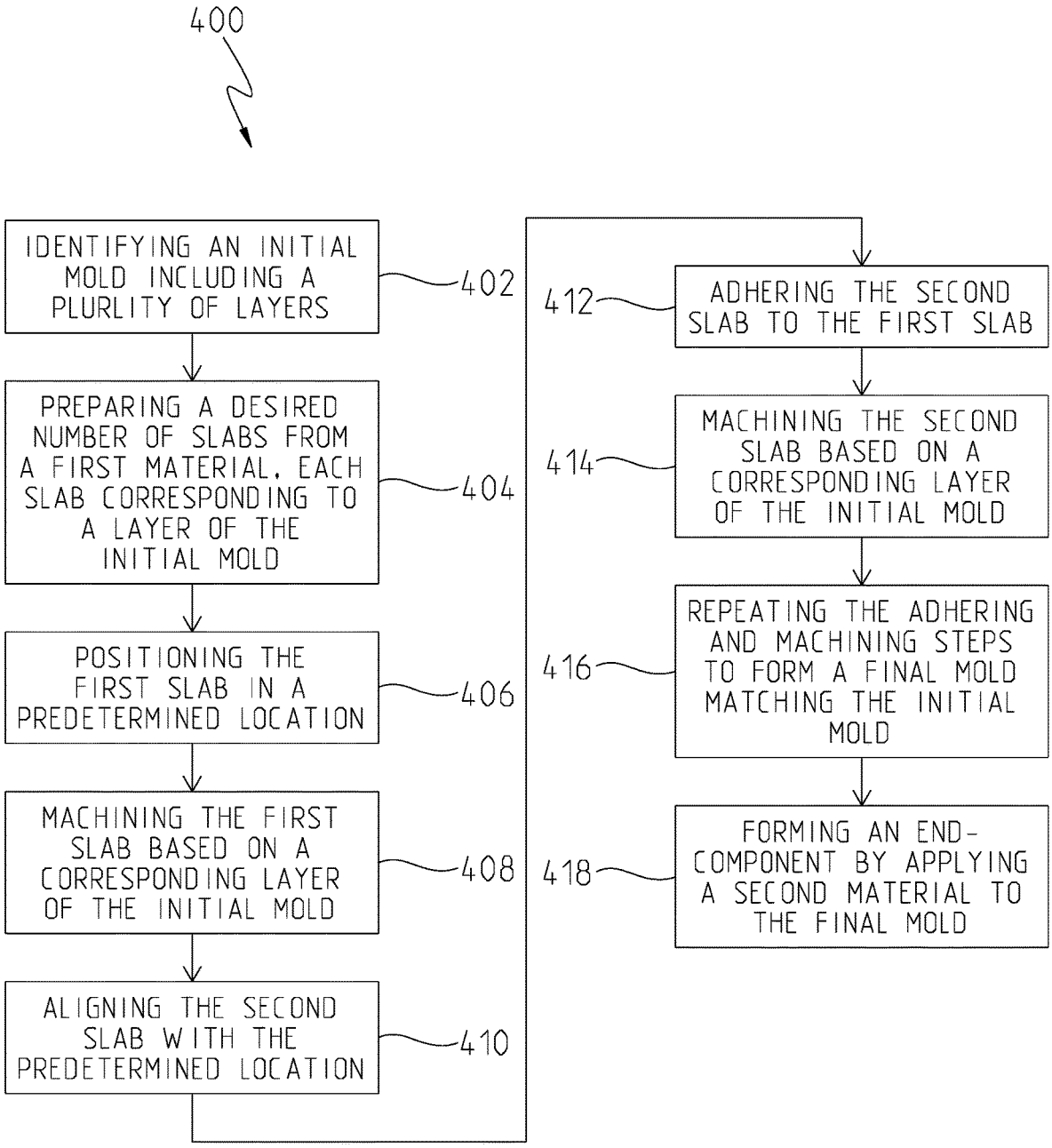
FIG. 11 illustrates a flow chart showing a method of manufacturing a final mold.

FIG. 11 illustrates a method 400 of manufacturing a final mold using layered slabs. As shown FIG. 11, the method 400 includes a step 402 of identifying an initial mold. The initial mold is a digital representation of the final mold, and the final mold is a physical object formed of slabs of material as described in greater detail below.

The initial mold comprises a plurality of layers. In illustrative embodiments, the layers may be vertically or horizontally extending portions of the initial mold. In some embodiments, each layer has a uniform height or thickness, and in other embodiments, the layers may differ in height or thickness from each other. The initial mold is a digital representation or three dimensional model of the final mold, and the final mold is used to create a plurality of end-components having mirror image but otherwise identical contours to the final mold, as will be described in greater detail below.

The method 400 further includes a step 404 of preparing a desired number of slabs including a first slab and a second slab. Each slab is comprised of a first material, and the first material is comprised of at least one of sand, steel, and aluminum. The desired number of slabs is equal to the number of layers included in the plurality of layers of the initial mold. Preparing a desired number of slabs includes forming each slab to have an identical border.

The method 400 proceeds to a step 406 of positioning the border of the first slab in a predetermined location that is associated with an automated machining tool (e.g. the machine tool 112).

The method 400 proceeds to a step 408 of machining the first slab based on a corresponding layer of the identified initial mold. Since the initial mold has already been identified (and therefore, the size and shape of the final mold is stored in memory of the controller 106), the machining tool 112 automatically removes the undesired portions of the first slab in response to instruction from the controller 106 to form a finished portion of the final mold. The machining tool 112 is able to do so since the first slab is in a known location relative to the machining tool 112 (i.e. the predetermined location). Machining step 408 includes removing an excess portion of the first slab to form a finished portion of the final mold. It should be appreciated that the finished portion of the final mold is identical to a corresponding layer of the initial mold.

The method 400 proceeds to a step 410 of aligning the second slab with the predetermined location. The aligning step 410 includes positioning the second slab adjacent (or above) the first slab such that the border of the second slab is aligned with the location at which the border of the first slab was positioned prior to the machining step 408. In some embodiments, in response to instruction from the controller 106, the slab placement tool 114 automatically moves the first slab to the predetermined location.

The method 400 proceeds to a step 412 of adhering the second slab to the first slab. In some embodiments, the adhesive application tool automatically applies adhesive to the finished portion of the first slab the second slab 126 in response to instruction from the controller 106. The second slab may be coupled to the first slab after the adhesive is applied to one of the slabs. In some embodiments, the coupling of the slabs may be performed by the slab placement tool 114 in response to instruction by the controller 106.

The method 400 proceeds to a step 414 of machining the second slab based on a corresponding layer of the identified initial mold. The machining step 414 includes removing an excess portion of the second slab to form another finished portion of the final mold. It should be appreciated that the another finished portion of the final mold is identical to a corresponding layer of the initial mold.

The method 400 proceeds to a step 414 of repeating the adhering step 412 and subsequent machining step 414 to form the final mold. The step 414 is repeated the number of times that is required such that slabs are constructed for each corresponding layer of the initial mold. In other words, the desired number of slabs to be prepared is equal to the number of layers included in the plurality of layers of the initial mold.

After the repeating step 416, the method 400 proceeds to a step 418 of forming an end-component by applying a second material to the final mold. Step 418 may be repeated based on the desired number of end-components to be created from the final mold.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are initial to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A method of manufacturing a final pattern for a mold using layered slabs, the method comprising:

preparing a desired number of slabs including a first slab and a second slab;

machining the first slab with an automated machining tool;

adhering the second slab to the first slab;

machining the second slab with the automated machining tool;

repeating the adhering step and subsequent machining step for each additional slab included in the desired number of slabs to form the final pattern; and identifying an initial pattern prior to the step of preparing the desired number of slabs, wherein the initial pattern is a three dimensional model of the final pattern, wherein the initial pattern comprises a plurality of layers;

wherein preparing the desired number of slabs includes forming each slab to include a near net shape corresponding to a layer of the initial pattern; and wherein preparing the desired number of slabs includes forming each slab to have an identical border surrounding the near net shape of the slab.

2. The method of claim 1, wherein each slab is comprised of a first material; and the method further comprises:

applying a second material to the final pattern;

shaping the second material to match contours of the final pattern;

removing the second material from the final pattern to form a mold; and forming an end-component by applying a third material to the mold;

wherein the first material is comprised of at least one of: polyamide, acrylonitrile styrene acrylate, polycarbonate, thermoplastic polyurethane, polypropylene, another thermal plastic, steel weld wire, and aluminum weld wire; and wherein the second material is comprised of at least one of: sand, steel, and aluminum.

3. The method of claim 1, wherein the automated machining tool includes a machining portion having a length;

wherein each slab included in the desired number of slabs has a height;

and wherein the length of the machining portion of the automated machining tool is greater than the height of each slab, respectively.

4. The method of claim 1, further comprising:

identifying an initial pattern prior to the step of preparing the desired number of slabs, wherein the initial pattern is a three dimensional model of the final pattern, wherein the initial pattern comprises a plurality of layers; and wherein the desired number of slabs is equal to the number of layers included in the plurality of layers of the initial pattern.

5. The method of claim 1, wherein preparing the desired number of slabs includes forming each slab to include a grid of at least one repeating geometric shape coupled to the border and the near net shape of the slab.

6. The method of claim 5, wherein each machining step includes:

removing the grid and border from the near net shape of the slab; and removing an excess portion of the near net shape of the slab based on a corresponding layer of the identified initial pattern to form a finished portion of the final pattern.

7. The method of claim 6, wherein the adhering step includes adhering a near net shape of the second slab to the finished portion of the first slab.

8. The method of claim 5, further comprising:

positioning the border of the first slab in a predetermined location that is associated with an automated machining tool prior to machining the first slab.

9. The method of claim 8, further comprising:

aligning the second slab with the predetermined location prior to adhering the second slab to the first slab.

10. A method of manufacturing a final pattern for a mold using layered slabs, the method comprising:

preparing a first slab;

machining the first slab;

preparing a second slab atop the first slab such that the second slab is coupled to the first slab;

machining the second slab;

repeating the preparing atop step and the subsequent machining step for each additional slab included in the final pattern; and identifying an initial pattern prior to the step of preparing the first slab, wherein the initial pattern is a three dimensional model of the final pattern, wherein the initial pattern comprises a plurality of layers;

wherein the preparing and preparing atop steps include forming each slab to include a near net shape corresponding to a layer of the initial pattern; and wherein the preparing and preparing atop steps includes forming each slab to have an identical border surrounding the near net shape of the slab.

11. The method of claim 10, wherein the preparing and preparing atop steps include:

forming each slab to include a grid of at least one repeating geometric shape coupled to the border and the near net shape of the slab.

12. The method of claim 11, wherein the machining step includes:

removing the grid and border from the near net shape of the slab; and removing an excess portion of the near net shape of the slab based on a corresponding layer of the identified initial pattern to form a finished portion of the final pattern.

13. The method of claim 12, further comprising: positioning the border of the first slab in a predetermined location that is associated with an automated machining tool prior to machining the first slab with the automated machining tool; and wherein preparing a second slab atop the first slab includes aligning the second slab with the predetermined location.

14. A method of manufacturing a final mold using layered slabs, the method comprising:

identifying an initial mold that is a three dimensional model of a final mold, wherein the initial mold comprises a plurality of layers;

preparing a desired number of slabs including a first slab and a second slab, wherein each slab is comprised of a first material;

machining the first slab based on a corresponding layer of the identified initial mold;

adhering the second slab to the first slab;

machining the second slab based on a corresponding layer of the identified initial mold;

repeating the adhering step and subsequent machining step for each additional slab included in the desired number of slabs to form the final mold; and forming an end-component by applying a second material to the final mold;

wherein preparing the desired number of slabs includes forming each slab to have an identical border.

15. The method of claim 14, wherein the first material is comprised of at least one of: sand, steel, or aluminum.

16. The method of claim 14, further comprising:

positioning the border of the first slab in a predetermined location that is associated with an automated machining tool prior to machining the first slab with the automated machining tool; and aligning the second slab with the predetermined location prior to adhering the second slab to the first slab.

* * * * *